United States Patent [19]

Morris, Jr.

[11] 4,238,069

[45] Dec. 9, 1980

[54] ONE-PIECE CORRUGATED CONTAINER

[76] Inventor: George A. Morris, Jr., P.O. Box 76136, Atlanta, Ga. 30326

[21] Appl. No.: 65,377

[22] Filed: Aug. 9, 1979

[51] Int. Cl.[3] ..... B65D 5/46; B65D 5/10; B65D 5/02

[52] U.S. Cl. ..... 229/52 B; 229/31 FS; 229/39 R

[58] Field of Search ..... 229/52 B, 33, 31 FS, 229/39

[56] References Cited

U.S. PATENT DOCUMENTS

| | | | |
|---|---|---|---|
| 1,135,742 | 4/1915 | Voris | 229/52 B X |
| 1,997,343 | 4/1935 | Quagliotti | 229/52 B |
| 2,007,810 | 7/1935 | Oman | 229/52 B |
| 2,151,472 | 3/1939 | Hubbard | 229/52 B |
| 2,714,982 | 8/1955 | Strauss | 229/52 B X |
| 2,954,914 | 10/1960 | Herlihy | 229/52 B X |
| 3,581,974 | 6/1971 | Freeman | 229/52 B X |
| 3,722,782 | 3/1973 | Collie | 229/52 B X |
| 4,017,017 | 4/1977 | Vos | 229/52 B X |
| 4,136,816 | 1/1979 | Gardner | 229/33 |
| 4,171,763 | 10/1979 | Card | 229/52 B |

FOREIGN PATENT DOCUMENTS

| | | | |
|---|---|---|---|
| 1267551 | 6/1961 | France | 229/52 B |
| 915935 | 1/1963 | United Kingdom | 229/52 B |

*Primary Examiner*—Davis T. Moorhead
*Attorney, Agent, or Firm*—Woodford R. Thompson, Jr.

[57] ABSTRACT

A container formed of a unitary blank of foldable paperboard has a bottom panel generally rectangular in outline which is integrally connected to opposed end walls and side walls to provide an upwardly facing opening. Corner gussets between each end wall and the adjacent side wall are folded inwardly alongside the adjacent side wall with the free extremeties of the gussets adjacent each end wall carrying upstanding projections which overlap each other. An end flap on each end wall is folded inwardly along the inner surface of the adjacent gussets and has a slot along its fold line for receiving the adjacent upstanding projections. Opposed tabs on each end flap extend away from each other and lock between the adjacent gusset and the inner surface of the adjacent end wall. Inwardly folded side flaps on the side walls define a top for the container and have upwardly folded flaps on the free extremities thereof which carry upwardly projecting end tabs which project through aligned slots in the upstanding projections carried by the corner gussets.

5 Claims, 6 Drawing Figures

ONE-PIECE CORRUGATED CONTAINER

BACKGROUND OF THE INVENTION

This invention relates to a one-piece corrugated container and more particularly to such a container which shall be particularly adapted for use as a portable cooler.

Heretofore in the art to which my invention relates, various types of one-piece corrugated containers have been devised, such as that shown in the Jewell U.S. Pat. No. 4,142,665, the Burr U.S. Pat. No. 4,148,429 and the Garner U.S. Pat. No. 4,136,816. However, such containers have not been adapted for use as portable coolers due to the construction and arrangement thereof.

SUMMARY OF THE INVENTION

In accordance with my invention, I provide a one-piece corrugated container which is formed of a unitary blank of foldable paperboard which has an inner surface which is impervious to water. The container has a bottom panel which is generally rectangular in outline and is integrally connected to opposed end walls and side walls to provde an upwardly facing opening. The container is provided with improved corner gussets between each end wall and the adjacent side walls which are folded inwardly alongside the adjacent side wall to provide a sturdy construction. Upstanding projections are carried by the free extremities of the gussets adjacent each of the end walls with adjacent upstanding projections overlapping each other. Each end wall is provided with an end flap which is folded inwardly along the inner surface of the gussets adjacent thereto and a slot is provided along the fold line of the end flap in position to receive the adjacent upstanding projections to provide a sturdy construction. Each end flap is provided with opposed tabs which extend away from each other and lock between the adjacent gusset and the inner surface of the adjacent end wall. The top for the container is defined by inwardly folded side flaps on the side walls which in turn have upwardly folded flaps on the free extremities thereof which carry upwardly projecting end tabs that project through aligned slots in the upstanding projections carried by the corner gussets.

An object of my invention is to provide a one-piece corrugated container which may be stored and shipped in a flat condition, thus greatly facilitating the storage and shipment of the containers due to the fact that they take up a minimum of space.

Another object of my invention is to provide a corrugated container of the character designated which may be readily assembled at the point of sale or use with a minimum of effort and time.

A further object of my invention is to provide a corrugated container of the character designated which is not only impervious to water but the components thereof are so constructed and interlocked relative to each other that a very sturdy container is formed after assembly of the container, thus particularly adapting the container for use as a cooler for transporting beverages and the ice for cooling such beverages.

A still further object of my invention is to provide a corrugated container of the character designated in which flap members define a top for the container and at the same time have upwardly folded flaps on the free extremities thereof which extend alongside each other and are interconnected by upwardly projecting tabs to upstanding, overlapping projections carried by the corner gussets whereby the entire container is lifted by providing a hand receiving opening through the upwardly folded flaps which extend alongside each other.

DESCRIPTION OF THE DRAWINGS

A one-piece corrugated container embodying features of my invention is illustrated in the accompanying drawings, forming a part of this application, in which.

DETAILED DESCRIPTION

Figure 1:
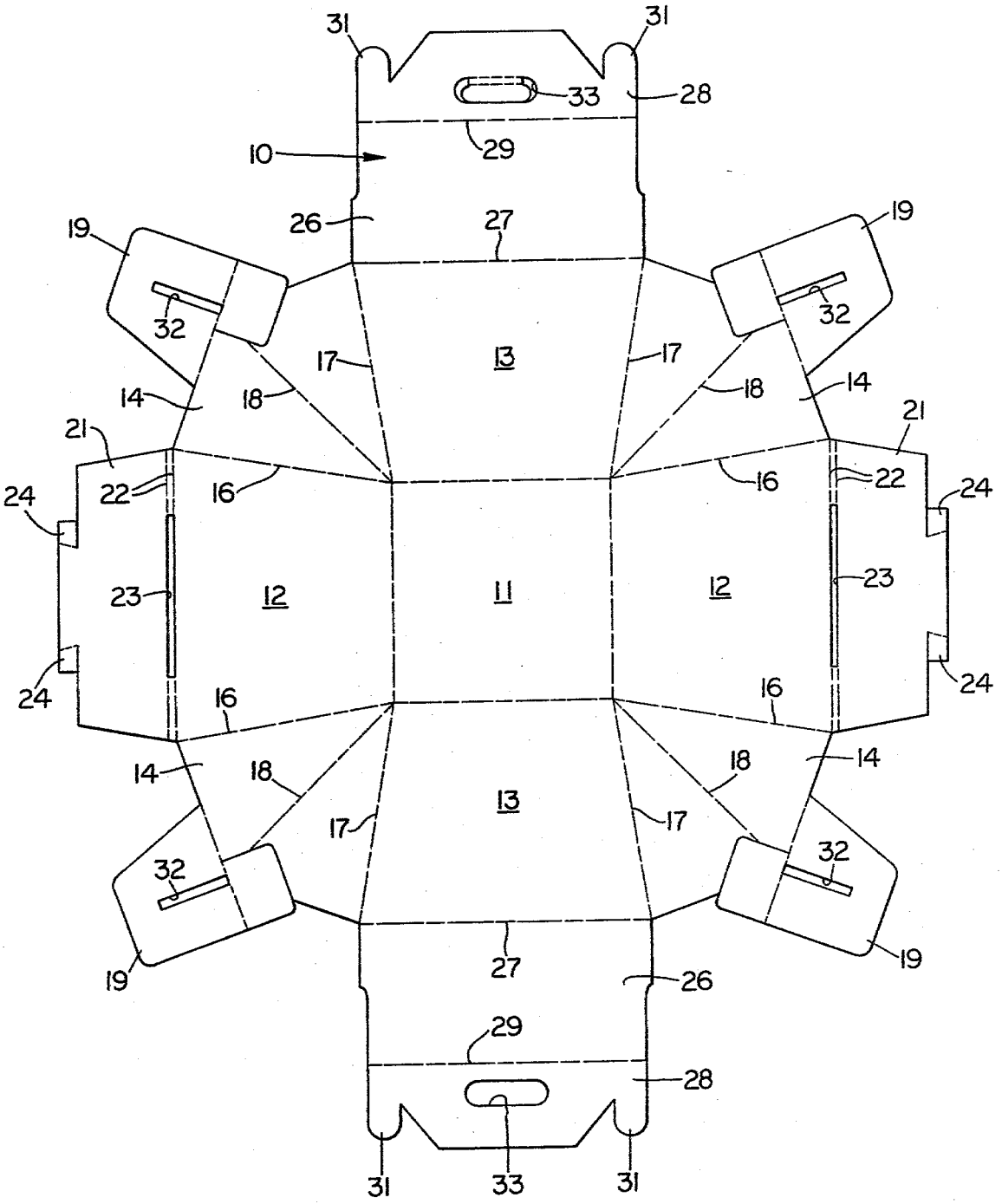
FIG. 1 is a top plan view showing a blank from which my improved container is formed.

Referring now to the drawings for a better understanding of my invention, I show a unitary blank 10 of foldable paperboard which is adapted to be folded along the fold lines, as shown in FIG. 1. The blank 10 comprises a central bottom panel 11 which is substantially rectangular in outline and is integrally connected to opposed end walls 12 and opposed side walls 13 to provide an upwardly facing opening, as shown in FIG. 3.

Figure 2:
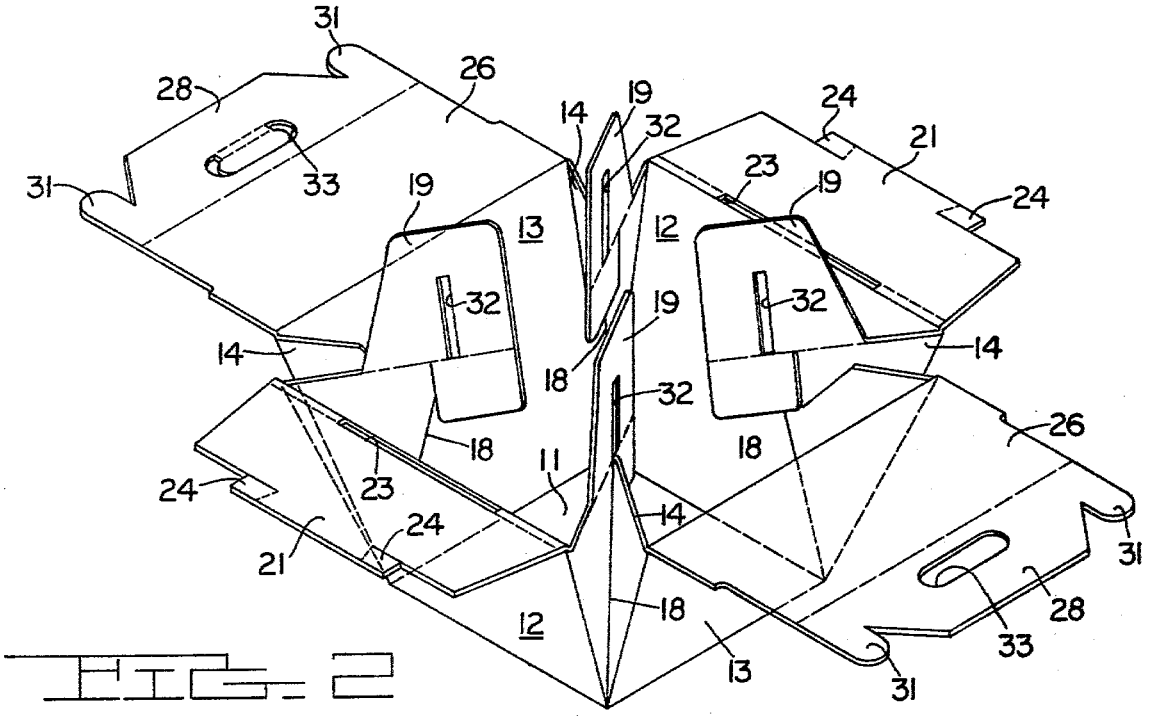
FIG. 2 is a perspective view showing my improved container partly assembled with the end walls and side walls in a partly raised position relative to each other.

As shown in FIGS. 1 and 2, corner gussets 14 are provided between each end wall 12 and the side walls 13 adjacent thereto with each corner gusset 14 being connected to the adjacent end wall 12 along a fold line 16 and being connected to the adjacent side wall 13 along a fold line 17. Each corner gusset 14 is folded inwardly along a centrally disposed fold line 18 to a position inwardly of the container and along the inner surface of the end wall 12 adjacent thereto, as shown in FIGS. 5 and 6.

Figure 5:
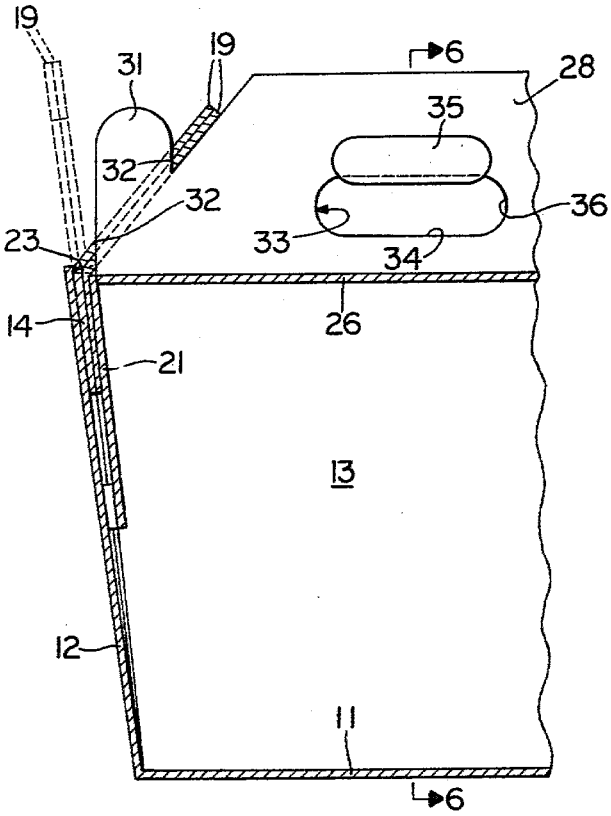
FIG. 5 is a fragmental, sectional view taken generally along the line 5—5 of FIG. 4 and showing in dotted lines the upstanding projections carried by the free extremities of the corner gussets at the left side of the container as being disconnected from the upwardly projecting tabs carried by the adjacent end of the upwardly folded flaps; and, FIG. 6 is a fragmental, sectional view taken generally along the line 6—6 of FIG. 5.
Figure 6:
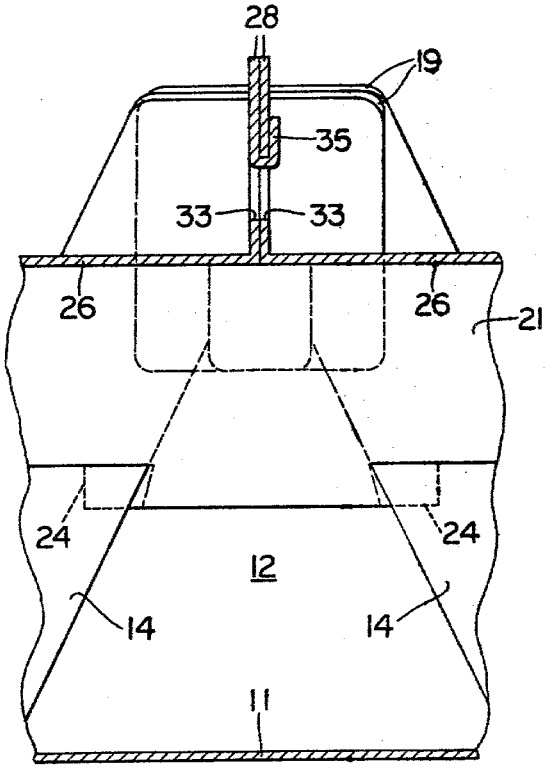
Figure 3:
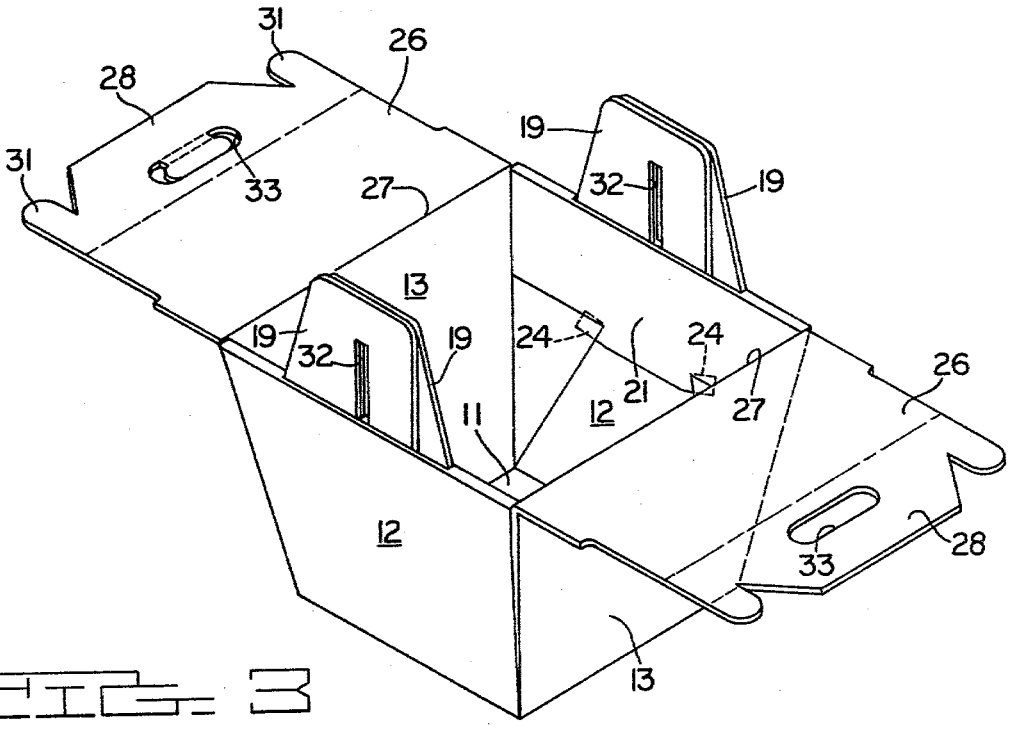
FIG. 3 is a perspective view showing the container in the assembled position with the flap members defining the top for the container being in the open position.
Figure 4:
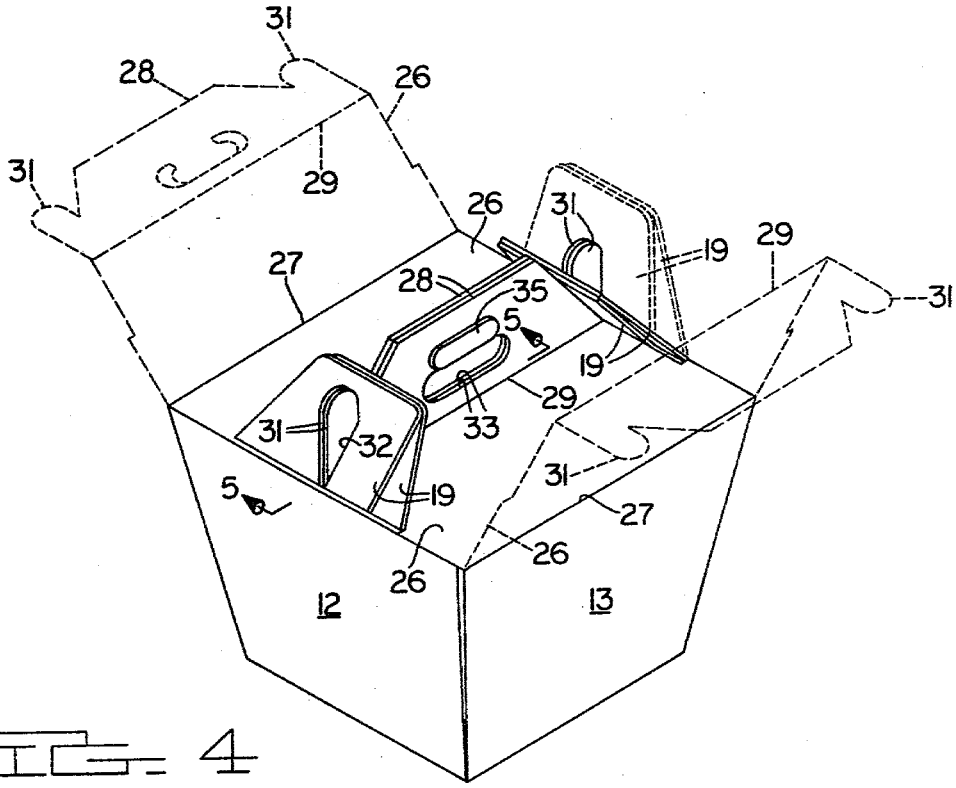
FIG. 4 is a perspective view showing the container in assembled position with the flap members defining the top for the container being moved to closed and locked position in solid lines and being shown in partly open position in the dotted line position, and also showing in dotted lines the upstanding projections carried by the free extremities of the corner gussets at the right side of the container as being disconnected from the upwardly projecting tab carried by the adjacent end of the upwardly folded flap.

Upstanding projections 19 are carried by the free extremities of each of the corner gussets 14 with the upstanding projections 19 carried by the corner gussets 14 adjacent each end wall 12 overlapping each other upon assembly of the container, as shown in FIGS. 3, 4 and 5. Formed integrally with the upper edge of each end wall 12 is an end flap member 21 which is adapted to be folded inwardly of the container along fold lines 22 to a position along the inner surface of the corner gussets 14 adjacent thereto, as shown in FIGS. 5 and 6. As shown in FIGS. 1, 2 and 5, an elongated slot 23 is provided along and between the fold lines 22 for the end flap 21 adjacent thereto in position to receive the upstanding projections 19 carried by the corner gussets 14. As shown in FIGS. 1, 2 and 6, opposed tabs 24 are provided on the free extremity of each of the end flaps 21 and extend laterally away from each other. Each tab 24 is folded under the corner gusset 14 adjacent thereto, as shown in FIG. 6, to lock the tab 24 between the corner gusset 14 adjacent thereto and the inner surface of the end wall 12 adjacent thereto.

As shown in FIGS. 1, 2, 3 and 4, side flap members 26 are integrally connected to the upper edges of the side walls 14 along fold lines 27 with the side flap members 26 being foldable from an open position, as shown in FIG. 3, to the closed position, as shown in solid lines in FIG. 4, to thereby define a top for the container. Formed integrally with the free extremities of each of the side flap members 26 is an upwardly folded flap 28 which is joined to the adjacent side flap member 26 along a fold line 29. The upwardly folded flaps 28 extend alongside each other, as shown in FIGS. 4 and 6.

Upwardly projecting tabs 31 are carried by the ends of each of the upwardly folded flaps 28, as shown. As shown in FIGS. 1–5, aligned slots 32 are provided in each of the upstanding, overlapping projections 19 carried by the corner gussets 14 for receiving the upwardly projecting tabs 31 carried by the upwardly folded flaps 28. Accordingly, upon moving the upstanding, overlapping projections 19 from the dotted line position shown in FIG. 5 to the solid line position, the upwardly projecting tabs 31 interlock with the upstanding projections 19 to thus form a sturdy connection between the upwardly folded flaps 28 and the upstanding, overlapped projections 19. Preferably, each upstanding projection 19 carried by the free extremities of each corner gusset 14 is formed integrally with the portion of its associated corner gusset 14 which is folded inwardly alongside and engages the inner surface of the end wall 12 adjacent thereto.

As clearly shown in FIGS. 4 and 6, aligned hand receiving openings 33 are provided through the adjacent, upwardly folded flaps 28 to define handle means for the container. As shown in FIGS. 5 and 6, one of the aligned openings 33 through the upwardly folded flaps 28 is defined by slits in its associated upwardly folded flap 28 along the lower portion 34 and the sides 36 of such opening with the portion 35 of the upwardly folded flap 28 inwardly of the slits 34 and 36 being bent laterally through the other opening 33 and then upwardly alongside the outer surface of the upwardly folded flap 28 adjacent thereto. Accordingly, the portion 35 of the upwardly folded flap 28 which extends inwardly of the slits 34 and 36 is joined to its associated upwardly folded flap 28 along the upper edge of the opening 33, as shown.

The inner surface of the blank 10 of folded paperboard is coated with a waterproof coating or the portion of the blank 10 adjacent the inner surface thereof is impregnated with a water impervious material whereby the blank 10 is impervious to water. Accordingly, my improved container is particularly adapted for carrying beverages and the ice for cooling the same.

From the foregoing, it will be seen that I have devised an improved one-piece corrugated container which is extremely simple of construction, economical of manufacture and one which is particularly adapted for mass production. By interconnecting the various components of the container as described hereinabove, I provide a very sturdy container which is adapted to carry relatively heavy quantities of beverages, ice and the like and at the same time any water resulting from melted ice remains within the confines of the container. Furthermore, by forming the container from a unitary blank of foldable paperboard which is assembled at the point of sale or use, the cost of storage and transportation is greatly decreased.

While I have shown my invention in but one form, it will be obvious to those skilled in the art that it is not so limited, but is susceptible of various changes and modifications without departing from the spirit thereof.

What I claim is:

1. A container formed of a unitary blank of foldable paperboard comprising:

(a) a central bottom panel substantially rectangular in outline and integrally connected to opposed end walls and opposed side walls to provide an upwardly facing opening, (b) corner gussets between each end wall and the side walls adjacent thereto with each said corner gusset being folded inwardly of the container along the inner surface of the end wall adjacent thereto, (c) upstanding projections carried by the free extremities of each of said corner gussets with said upstanding projections carried by the corner gussets adjacent each end wall overlapping each other, (d) an end flap member on each end wall folded inwardly of the container and along the inner surface of the corner gussets adjacent thereto, (e) there being an elongated slot along the fold line of each said end flap member disposed to receive said upstanding projections carried by the corner gussets adjacent thereto, (f) opposed tabs on the free extremity of each said end flap member extending laterally away from each other with each tab being folded under the corner gusset adjacent thereto to lock the tab between said corner gusset adjacent thereto and the inner surface of the end wall adjacent thereto, (g) side flap members on said side walls folded inwardly toward each other to define a top for the container and having upwardly folded flaps on the free extremities thereof extending alongside each other, (h) handle means carried by said upwardly folded flaps, (i) upwardly projecting tabs carried by the ends of each said upwardly folded flap, and (j) there being aligned slots in said upstanding overlapping projections carried by said corner gussets receiving said upwardly projecting tabs carried by said upwardly folded flaps.

2. A container as defined in claim 1 in which each said upstanding projection carried by the free extremities of each of said corner gussets is formed integrally with the portion of its associated corner gusset which is folded inwardly alongside and engages the inner surface of the end wall adjacent thereto.

3. A container as defined in claim 1 in which the inner surface of said blank of foldable paperboard is impervious to water.

4. A container as defined in claim 1 in which said handle means comprises aligned hand receiving openings through said upwardly folded flaps.

5. A container as defined in claim 4 in which one of said aligned openings through said upwardly folded flaps is defined by slits in its associated upwardly folded flap along the lower portion and sides of said one aligned opening with the portion of said upwardly folded flap inwardly of said slits being bent laterally through the other of said aligned openings and then upwardly alongside the outer surface of the upwardly folded flap adjacent thereto.

* * * * *